United States Patent [19]

Murai et al.

[11] Patent Number: 4,889,649

[45] Date of Patent: Dec. 26, 1989

[54] METHOD FOR TRANSMITTING POWER

[75] Inventors: Yoshikazu Murai, Yokohama; Tatsuo Yamaguchi, Tokyo; Kanji Mochizuki, Yokohama, all of Japan

[73] Assignee: Nippon Petrochemicals Company, Ltd., Tokyo, Japan

[21] Appl. No.: 157,505

[22] PCT Filed: Jun. 5, 1987

[86] PCT No.: PCT/JP87/00356

§ 371 Date: Feb. 4, 1988

§ 102(e) Date: Feb. 4, 1988

[87] PCT Pub. No.: WO87/07633

PCT Pub. Date: Dec. 17, 1987

[30] Foreign Application Priority Data

Jun. 5, 1986 [JP] Japan ..... 61-130919

[51] Int. Cl.[4] ..... C10M 105/04

[52] U.S. Cl. ..... 252/73; 585/20; 585/436; 208/14

[58] Field of Search ..... 252/73; 585/20, 436; 208/14

[56] References Cited

U.S. PATENT DOCUMENTS

| | | | |
|---|---|---|---|
| 3,411,369 | 11/1968 | Hammann et al. | 252/73 |
| 3,595,797 | 7/1971 | Duling et al. | 252/73 |
| 3,608,385 | 9/1971 | Duling et al. | 252/73 |
| 3,843,537 | 10/1974 | Duling et al. | 252/73 |
| 4,046,703 | 9/1977 | Duling et al. | 252/73 |
| 4,329,529 | 5/1982 | Nambu | 252/73 |
| 4,650,910 | 3/1987 | Henneke et al. | 568/655 |

*Primary Examiner*—Paul Lieberman
*Assistant Examiner*—Christine A. Skane
*Attorney, Agent, or Firm*—Scully, Scott, Murphy & Presser

[57] ABSTRACT

A method for transmitting power which is characterized by the use of a traction drive fluid containing, as a base stock, a composition composed of 40 to 80 wt % of 2,4-dicyclohexyl-2-methylpentane and 20 to 60 wt % of a mixture of polycyclohexylalkane and a perhydroindane derivative, with the weight ratio of the perhydroindane derivative to the polycycloalkane being up to 0.5, and having a viscosity (at 100° C.) of 5.0 to 15.0 cSt ($10^{-2}$ $cm^2$/sec). This fluid has a high traction coefficient and a good oxidation stability.

5 Claims, No Drawings

METHOD FOR TRANSMITTING POWER

TECHNICAL FIELD

This invention relates to an improved method for transmitting power using a traction drive fluid composition having a high viscosity and an excellent traction coefficient. More particularly, the invention relates to a method for transmitting power in which a composition comprising a mixture of hydrocarbons represented by specific chemical formulae is employed.

The method for transmitting power with traction drive is the one in which power is transmitted by shearing stress caused by an oil film of a traction drive fluid that is formed between rotating bodies (revolving bodies) which are rotating in relative relationship. This method is applied to traction drive devices such as transmission devices and change gears, for example, automatic transmission gears for automobiles, variable speed transmission devices and hydraulic torque converters. As for the traction drive fluids used for these devices, a high traction coefficient is required.

BACKGROUND ART

There are hitherto proposed a large number of compounds as traction drive fluids. For example, proposed in U.S. Pat. No. 3,652,418, etc., are decalin, perhydroanthracene, polycyclohexyl compounds, bicyclohexyl compounds, dicyclohexyl compounds, hydrogenation products of α-methylstyrene dimers, adamantanes, alkylbenzenes and hydrogenation products of styrenated cumene.

With the development in automobile technology in recent years, the sizes of the above-mentioned traction drive devices have been reduced, while they are used under severer conditions of higher speed and higher load. Accordingly, the use conditions for the traction drive fluids in these devices have become severer at higher temperatures.

Among the foregoing hitherto proposed compounds, however, those put into practice are not many because of their impractical traction coefficients and the difficulty of obtaining the raw materials for industrial-scale production. Only 2,4-dicyclohexyl-2-methylpentane proposed in U.S. Pat. No. 3,994,816 can be exemplified as a material that is acceptable for practical uses.

In the traction drive devices, as power is transmitted by the shearing stress caused by an oil film of a traction drive fluid that is formed between rotating bodies (revolving bodies) which are rotating in relative relationship, the thickness of the film must be maintained to a certain value. Accordingly, a viscosity to a certain level is required even in high temperature conditions. By this fact, high viscosity fluids are required recently. In addition, not only the viscosity but also a high traction coefficient is also necessary, of course.

Meanwhile, even in the case of the typical compound of 2,4-dicyclohexyl-2-methylpentane among those barely put into practice, the viscosity is not always satisfactory though the traction coefficient is high to some extent. In other words, the viscosity (at 100° C.) of this compound itself is only 3.6 cSt ($10^{-2}$ $cm^2$/sec). Therefore, it was proposed to add a viscosity index improving agent such as polymethacrylate and polyisobutylene in order to raise the viscosity. These viscosity index improving agent can raise the viscosity indeed, however, the traction coefficient is lowered to make the matter worse. In addition, when a traction drive fluid is used for a long period of time under severe conditions, undesirable results are often caused to occur that the viscosity is lowered due to the deterioration by the addition of these additives. Because the traction drive fluid is subjected to quite severe conditions in view of oxidation reaction, the requirement with regard to oxidation stability is also very severe.

Incidentally, various lubricants have been proposed and put into practice for the use in rotating members such as rotary bearings in which parts are rotated freely and substantially independently. For example, a mixture of hydrogenated linear dimer of α-methylstyrene and hydrogenated linear trimer of the same is proposed In U.S. Pat. No. 3,925,217. However, what is called lubricant oil improves the sliding among rotating members to allow them to rotate freely or separately, which fact contrasts with the function of the traction drive fluid. In other words, the lubricant oil is used to assure the free or independent movement, which is quite different from the functions and effects of the traction drive fluid according to the present invention. Therefore, it is not possiible at all to suppose the function and effect in power transmission of the present invention from the function and effect of such a lubricating oil. In other words, it is general to consider that the so-called lubricant oil used for rotary bearing members to allow them to rotate freely and independently, is not suitable for use as a traction drive fluid. Accordingly, those skilled in the art cannot suppose that the lubricant oil disclosed in the foregoing patent specification is useful as a traction drive fluid.

Furthermore, it is disclosed in U.S. Pat. Nos. 3,595,796 and 3,598,740 that the trimers of α-methylstyrene is used as a traction drive fluid. However, all the oligomers disclosed in these patent specifications are what is called cyclic compounds of hydroindane type or compositions mainly containing these cyclic compounds. The present inventors have made detailed investigation in view of the foregoing severe standards required in recent years in connection with traction drive fluids. As a result, it was found that the cyclic compounds disclosed in the above patent specification, especially cyclic trimers and cyclic tetramers, have low oxidation stability and they cannot meet the recent severe requirement level.

DISCLOSURE OF INVENTION

It is the object of the present invention to improve a traction drive fluid composition comprising 2,4-dicyclohexyl-2-methylpentane (hereinafter sometimes referred to as DCHP). More particularly, the invention provides a novel traction drive fluid composition which has an excellent traction coefficient, a high viscosity and an excellent oxidation stability as compared with the already used typical compound of 2,4-dicyclohexyl-2-methylpentane.

That is, the present invention relates to a method for transmitting power which is characterized by the use of a traction drive fluid containing, as a base stock, a composition composed of 40 to 80 wt % of 2,4-dicyclohexyl-2-methylpentane and 20 to 60 wt % of the compounds represented by the following formulae (I) to (IV) with the weight ratio of the sum of the compounds represented by the following formulae (III) and (IV) to the sum of the compounds represented by the following formulae (I) and (II) being up to 0.5, and having a viscosity (at 100° C.) in the range of 5.0 to 15.0 cSt ($10^{-2}$ $cm^2/sec$), thereby transmitting power by shearing stress caused by an oil film of a traction drive fluid composition that is formed between rotating bodies (revolving bodies) which are rotating in relative relationship. The compounds of polycyclohexylalkanes represented by formulae (I) and (II) and the compounds of perhydroindane derivatives represented by formulae (III) and (IV) are shown in the following.

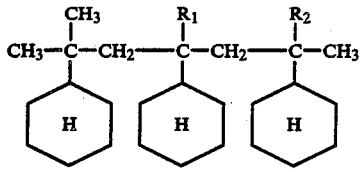

(I)

(in the formula, $R_1=CH_3$, $R_2=H$, or $R_1=H$, $R_2=CH_3$)

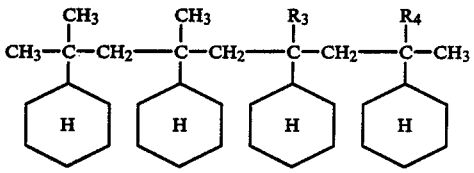

(II)

(in the formula, $R_3=CH_3$, $R_4=H$, or $R_3=H$, $R_4=CH_3$)

(III)

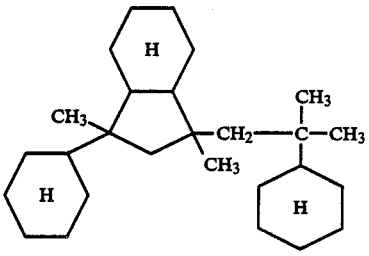

(IV)

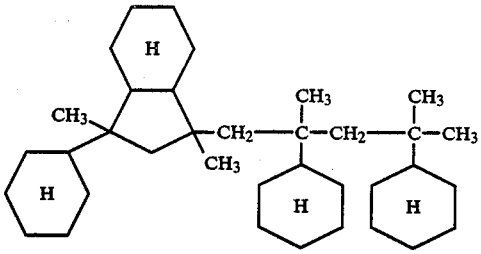

The compounds represented by the above formula (I) or (II) are highly viscous liquids or solids, and the compounds themselves are not suitable for use as traction drive fluids. However, when they are mixed with 2,4-dicyclohexyl-2-methylpentane, they can raise the viscosity of the fluid, and at the same time, the traction coefficient is not lower but rather raised owing to the synergistic effect among the respective components.

The total quantity of 20 to 60 wt % of the above compounds of the formulae (I) to (IV) is mixed to 2,4-dicyclohexyl-2-methylpentane. When the quantity is less than 20 wt %, neither the rise of viscosity nor the synergistic effect to raise traction coefficient can be expected. On the other hand, in the case that the above total quantity exceeds 60 wt %, viscosity becomes too high. Accordingly, both of the above are not desirable.

More preferably, the upper limit of the quantity of the compound of the formula (I) to be mixed is 40 wt % and the upper limit of the quantity of the compound of the formula (II) is 15 wt %. Even though any one of the compounds of the formulae (I) and (II) can be used by being mixed singly, it is desirable for the purpose of the present invention that both the compounds are used together.

Furthermore, because the oxidation stability of the above compounds of formulae (III) and (IV) are inferior in oxidation stability, the weight ratio of total quantity of the above compounds of formulae (III) and (IV) to the total quantity of the above compounds of formulae (I) and (II) is preferably not more than 0.5. When the weight ratio of total quantity of the above compounds of formulae (III) and (IV) exceeds 0.5, the oxidation stability of obtained fluid composition is undesirably lowered.

In addition, the traction drive fluid composition according to the present invention has preferably a viscosity (at 100° C.) in the range of 5.0 to 15.0 cSt ($10^{-2}$ $cm^{-2}/sec$) in view of the recently required standards as a traction drive fluid for automobile transmission gears.

In the preparation of the fluid composition of the present invention, the ratios of 2,4-dicyclohexyl-2-methylpentane, the compound of the foregoing formula (I) and the compound of formula (II) are appropriately selected so as to obtain a mixture having a viscosity in the above viscosity range and a suitable ratio of cyclic compounds.

2,4-Dicyclohexyl-2-methylpentane and the compounds of the foregoing formulae (I) and (II) can be easily prepared by, for example, polymerizing α-methylstyrene, or thermally decomposing poly(α-methylstyrene) to obtain corresponding aromatic hydrocarbons of triarylalkanes and tetraarylalkanes, and then subjecting them to hydrogenation.

Incidentally, when they are prepared from α-methylstyrene or its polymer, the cyclic compounds of the above formulae (III) and (IV) is liable to be produced as by-products (even though aromatic hydrocarbons are directly produced, they are represented in hydrogenated forms).

As referred to above, the oxidation stability of these cyclic compounds is low, which is not desirable for the purpose of the present invention. These compounds have about the same molecular weights and boiling points as those of the compounds of the above formulae (I) and (II). Therefore, the separation of them is not easy in either before hydrogenation or after hydrogenation. Accordingly, it is important that the formation of these compounds is avoided when preparation is done using α-methylstyrene.

It is, therefore, desirable that polymerization conditions may be properly selected when α-methylstyrene is polymerized for preparation. For example, with respect to the starting monomer, 2 to 30 wt % of a solid acid catalyst such as acid clay, activated clay, silica-alumina, montmorrilonite type clay, or silica gel is used, and 30 to 300 wt %, with respect to the catalyst, of an oxygen-containing compound such as water, dihydric alcohol, or ether is added as a reaction moderator. Furthermore, the reaction is carried out at temperatures in the range of 30° to 150° C. The type of reaction can be any of batchwise reaction and continuous reaction.

The aromatic rings of triarylalkane and tetraarylalkane obtained by polymerizing α-methylstyrene is then hydrogenated. This hydrogenation of aromatic rings is carried out by bringing hydrogen and the mixture of the material to be hydrogenated into contact with a known hydrogenation catalyst for aromatic rings such as nickel, nickel-diatomaceous earth, Raney nickel, platinum, platinum-alumina, rhodium, and rhodium-alumina, under reaction conditions of 250° C. or lower and 30 kg/cm$^2$ or higher. By this hydrogenation of aromatic rings, ethylenic double bonds can also be hydrogenated simultaneously. The rate of hydrogenation is at the lowest 80%, preferably not lower than 90%, and more preferably not lower than 95%. In general, it is not necessary to remove almost the aromatic hydrocarbons or compounds having double bonds because it is difficult to remove most of them to a level lower than 1% and the object of the present invention is not hindered so long as the quantities of them are small.

Appropriate ratios of known additives for lubricant oil can be added to the fluid composition of the present invention, which additives are exemplified by antioxidants of phenol compounds such as 2,6-di-tert-butyl-p-cresol, amine compounds such as phenyl-α-naphthylamine, sulfur compounds such as sulfide and disulfide, and organometallic compounds such as dialkyldithio zinc phosphate; extreme pressure additives of sulfur compounds such as sulfurized fatty oil, phosphorus compounds such as phosphoric ester and phosphorous ester, and organometallic compounds such as thiophosphate and thiocarbamate; rust inhibitors such as amines, esters and metal salts; viscosity index improvers such as poly(meth)acrylate, polyisobutylene and its hydrogenation product; and defoaming agents such as silicone compounds. For example, 0.01 to 5 wt % of the above antioxidant can be added to the fluid composition of the present invention.

Furthermore, known organic or inorganic thickners for grease such as metallic soap, synthetic polymers, polyurea, organosiloxanes, clays, bentonite, and colloidal silica can be mixed so as to enable to use the composition as a traction grease.

In addition to the fact that known compounds in arbitrary ratio can be added to the fluid composition of the present invention, the above-mentioned by-product of cyclic dimers formed in the polymerization of α-methylstyrene can be contained as far as the effect of the present invention is attained.

BEST MODE FOR CARRYING OUT THE INVENTION

In the following, the present invention will be described with reference to examples thereof.

EXAMPLE 1

A catalyst of 200 cc of activated clay (Galleonite 236, made by Mizusawa Industrial Chemicals, Ltd.) was baked at 120° C. for 3 days and α-methylstyrene was polymerized using this catalyst in a continuous flow system. The activity of the catalyst was previously adjusted by being immersed in 2.2 times by volume of methyl cellosolve. The reaction conditions were as follows:

Reaction Temperature: 45° C.

S/V: 2.4 hr$^{-1}$

Recycle/New feed: 2.4 (vol/vol)

A fraction having boiling points up to up to 400° C. (as atmospheric pressure) was distilled from the obtained reaction mixture, to recover a fraction of $C_{27}$ and higher. (Yield: 50 wt %)

To this fraction was added 2 wt % of nickel-diatomaceous earth catalyst (trademark: N-113, made by Nikki Chemical Corp.) and hydrogenation was carried out at 200° C. and 80 kg/cm$^2$ for 8 hours in an autoclave. The obtained reaction product was analyzed by GC, GPC and GC mass spectrometer to obtained a composition as shown in Table 1.

A composition was prepared by adding 50.5 parts by weight of DCHP to 49.5 parts by weight of the above components. The kinematic viscosity at 100° C. was 8.3 cSt ($10^{-2}$ cm$^2$/s); pour point, −25° C.; and traction coefficient, 0.100. The oxidation life (RBOT method) was 340 minutes.

| (Test Methods) | |
|---|---|
| Traction Coefficient Measuring Conditions: | |
| Rotational speed of disk: | 1,500 rpm |
| Average Hertz stress: | 92.5 kgf/mm$^2$ |
| Slip ratio: | 2% |
| Temperature: | 25° C. |
| Oxidation Stability (Oxidation Life): | |
| Measured by RBOT method | |
| (according to ASTM D-2772) | |
| Oxidation Test Conditions: | |
| Quantity of test sample: | 50 g |
| Temperature: | 150° C. |
| Initial pressure of oxygen: | 6.3 kg/cm$^2$ |
| Oxidation catalyst: | Copper and iron |

Values were indicated by a unit of minute, wherein a higher velue indicates that the oxidation life is long. In the oxidation stability test, 0.5 wt % of 2,6-di-tert-butyl-p-cresol as an antioxidant was added to each test sample.

TABLE 1

| Fraction Content | Composition | |
|---|---|---|
| $C_{27}$ 72.1 wt % | 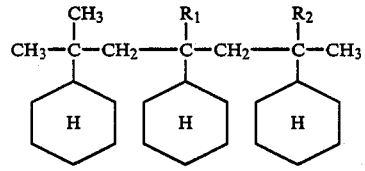 | 69.5 wt % |

(In the formula, $R_1$ = $CH_3$, $R_2$ = H, or $R_1$ = H, $R_2$ = $CH_3$)

TABLE 1-continued

| Fraction Content | Composition | |
|---|---|---|
| | 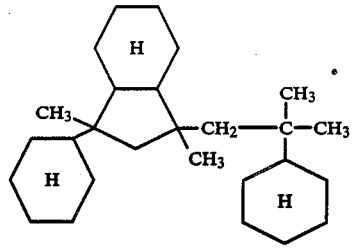 | 2.6 wt % |
| $C_{36}$ 27.9 wt % | 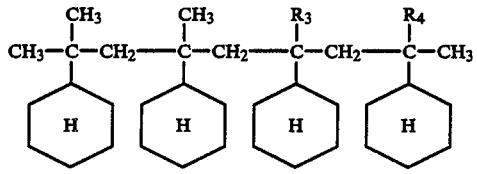 (In the formula, $R_3 = CH_3$, $R_4 = H$, or $R_3 = H$, $R_4 = CH_3$) | 27.2 wt % |
| | 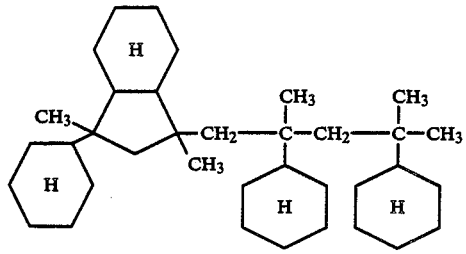 | 0.7 wt % |

EXAMPLE 2

α-Methylstyrene was allowed to react according to the conditions in Example 1 except that the reaction temperature was 65° C.

A fraction having boiling points up to 250° C. (as atmospheric pressure) was distilled from the obtained reaction mixture, to recover a fraction of $C_{18}$ and higher. (Yield: 90 wt %)

To this fraction was added 2 wt % of N-113 catalyst and hydrogenation was carried out at 200° C. and 50 kg/cm$^2$ for 5 hours in an autoclave. The obtained reaction product was analyzed likewise to obtained a composition as shown in Table 2.

The kinematic viscosity at 100° C. of this composition was 6.7 cSt ($10^{-2}$ cm$^2$/s); pour point, −27.5° C.; and traction coefficient, 0.097. The oxidation life was 300 minutes.

TABLE 2

| Fraction Content | Composition | |
|---|---|---|
| $C_{18}$ 69.9 wt % | D C H P | 64.5 wt % |
| | 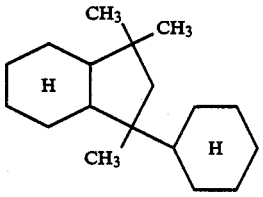 | 5.4 wt % |
| $C_{27}$ 21.3 wt % | 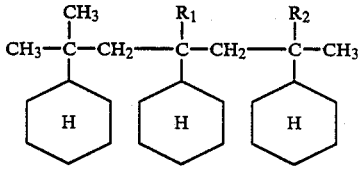 (In the formula, $R_1 = CH_3$, $R_2 = H$, or $R_1 = H$, $R_2 = CH_3$) | 15.7 wt % |

TABLE 2-continued

| Fraction Content | Composition | |
|---|---|---|
| | 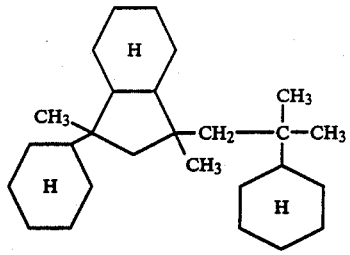 | 5.6 wt % |
| $C_{36}$ 8.8 wt % | 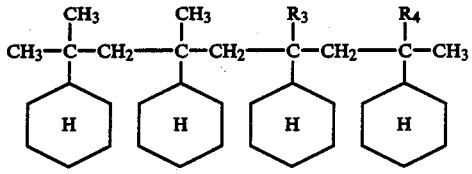 (In the formula, $R_3 = CH_3$, $R_4 = H$, or $R_3 = H$, $R_4 = CH_3$) | 6.9 wt % |
| | 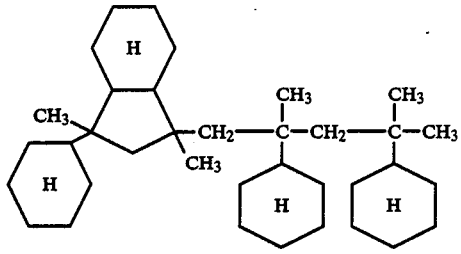 | 1.9 wt % |

COMPARATIVE EXAMPLE 1

To a 1 liter separable flask with a condenser and a stirrer was added 165 cc of α-methylstyrene dimer that was recoverd from the fraction of $C_{18}$ and higher obtained in Example 2 and 15 cc of methyl cellosolve. Meanwhile, 3 g of activated clay (Galleon Earth NSR, made by Mizusawa Industrial Chemicals, Ltd.) was dried at 120° C. for 3 days and put into the above and temperature was raised to 115° C. with stirring. With maintaining temperature at 115° to 120° C., 420 cc of α-methylstyrene was poured at a rate of 140 cc/hr for 3 hours. After that stirring was continued for further 3 hours. After the reaction, the reaction mixture was separated from the catalyst by filtration.

A fraction having boiling points up to 250° C. was distilled from the obtained reaction mixture, to recover a fraction of $C_{18}$ and higher (Yield: 85 wt %). To this fraction was added 2 wt % of N-113 catalyst and hydrogenation was carried out at 200° C. and 50 kg($H_2$)/cm$^2$ for 5 hours in an autoclave. The obtained reaction product was analyzed likewise to obtained a composition as shown in Table 3.

The kinematic viscosity at 100° C. of this composition was 4.6 cSt; pour point, −40° C.; and traction coefficient, 0.090. The oxidation life was 290 minutes.

TABLE 3

| Fraction Content | Composition | |
|---|---|---|
| $C_{18}$ 87.4 wt % | D C H P | 85.3 wt % |
| | 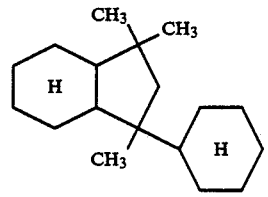 | 2.1 wt % |
| $C_{27}$ 10.4 wt % | 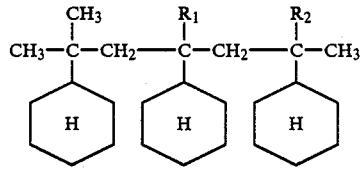 (In the formula, $R_1 = CH_3$, $R_2 = H$, or $R_1 = H$, $R_2 = CH_3$) | 8.3 wt % |

TABLE 3-continued

| Fraction Content | Composition | |
|---|---|---|
| | 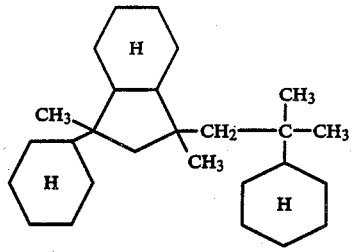 | 2.1 wt % |
| $C_{36}$ 2.2 wt % | 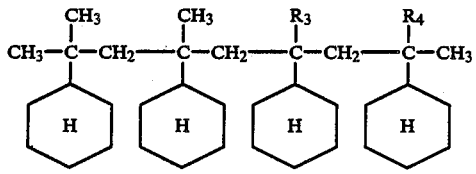 (In the formula, $R_3 = CH_3$, $R_4 = H$, or $R_3 = H$, $R_4 = CH_3$) | 1.9 wt % |
| | 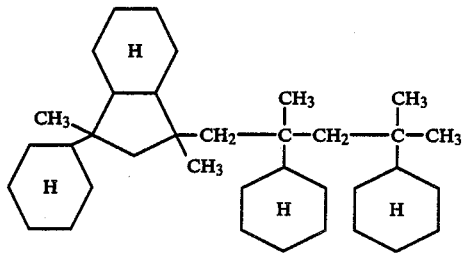 | 0.3 wt % |

COMPARATIVE EXAMPLE 2

α-Methylstyrene was allowed to react according to the conditions in Example 1 except that the reaction temperature was 65° C.

A fraction having boiling points up to 250° C. (as atmospheric pressure) was distilled from the obtained reaction mixture, to recover a fraction of $C_{18}$ and higher (Yield: 90 wt %).

To a 1 liter separable flask equipped with a condenser and a stirrer were fed 200 cc of this fraction, 5 cc of methyl cellosolve and 3 g of activated clay (trademark: Galleon Earth NSR, made by Mizusawa Industrial Chemicals, Ltd.) which had been dried at 120° C. for 3 days, and the contents were stirred at 80° C. for 1 hour.

After the reaction, the reaction mixture was separated from the catalyst by filtration.

To this reaction product, 2 wt % of a hydrogenation catalyst of N-113 catalyst and hydrogenation was carried out at 200° C. and 50 kg/cm$^2$ for 5 hours in an autoclave. The obtained reaction product was analyzed likewise to obtained a composition as shown in Table 4.

The kinematic viscosity at 100° C. of this composition was 8.9 cSt (at 100° C.); pour point, −27.5° C.; and traction coefficient, 0.096. The oxidation life was as short as 210 minutes.

TABLE 4

| Fraction Content | Composition | |
|---|---|---|
| $C_{18}$ 69.9 wt % | D C H P | 58.0 wt % |
| | 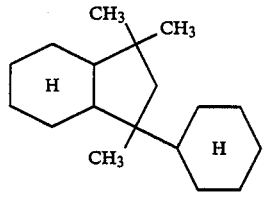 | 11.9 wt % |

TABLE 4-continued

| Fraction Content | Composition | |
|---|---|---|
| $C_{27}$ 20.1 wt % | 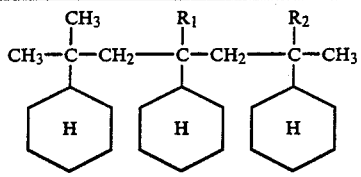 (In the formula, $R_1 = CH_3$, $R_2 = H$, or $R_1 = H$, $R_2 = CH_3$) | 11.2 wt % |
| | 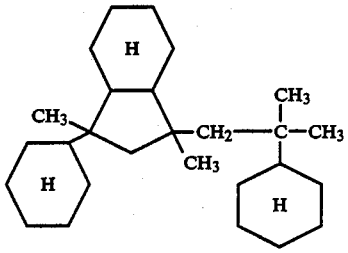 | 8.8 wt % |
| $C_{36}$ 10.0 wt % | 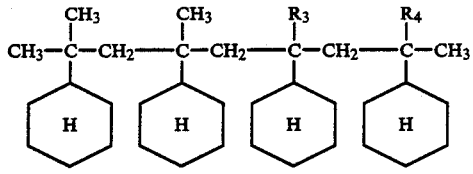 (In the formula, $R_3 = CH_3$, $R_4 = H$, or $R_3 = H$, $R_4 = CH_3$) | 6.3 wt % |
| | 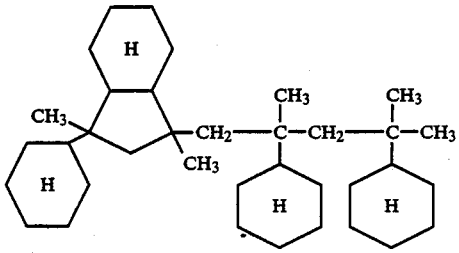 | 3.7 wt % |

COMPARATIVE EXAMPLE 3

The kinematic viscosity at 100° C. of 2,4-dicyclohexyl-2-methylpentane was 3.6 cSt; pour point, −42.5° C.; and traction coefficient, 0.087. The oxidation life was 310 minutes.

The results in the foregoing examples and comparative examples are summarized in the following Table 5.

TABLE 5

| Item | Example 1 | Example 2 | Comparative Example 1 | Comparative Example 2 | Comparative Example 3 |
|---|---|---|---|---|---|
| Content of Heavier Components (wt %) | 49.5 | 31.8 | 12.8 | 34.1 | 0.0 |
| Ratio by Weight | 0.03 | 0.33 | 0.23 | 0.76 | 0.00 |
| Viscosity(1) | 8.3 | 6.7 | 4.6 | 8.9 | 3.6 |
| Oxidation Life(2) | 340 | 300 | 290 | 210 | 310 |
| Traction Coefficient | 0.100 | 0.097 | 0.090 | 0.096 | 0.087 |

Notes:
Viscosity(1): cSt (= $10^{-2}$ $cm^2$/sec)
Temperature: At 100° C.
Oxidation Life(2): RBOT method, unit: minute

SUMMARY DISCUSSION ON EXPERIMENTAL RESULTS

From the results shown in the foregoing Table 5, it will be understood that the values in kinematic viscosity, traction coefficient and oxidation stability of the composition in Examples are superior to those of the composition in Comparative Examples. In other words, in any Examples, the traction coefficient is improved as compared with the value in Comparative Example of only 2,4-dicyclohexyl-2-methylpentane. This fact shows the synergistic effect among the respective components. As the contents of compounds of the foregoing formulae (I) to (IV) are too small in the fluid composition in Comparative Example 1, it is not desirable because the viscosity is low even though the traction coefficient is high to some degree. Furthermore, with respect to the fluid composition (Comparative Example 2) containing much compounds of formulae (III) and (IV), it is shown that the oxidation stability is inferior.

We claim:

1. A method for transmitting power comprising the use of a traction drive fluid containing, as a base stock, a composition comprising:

(1) 40 weight % to 80 weight % of 2,4-dicyclohexyl-2-methylpentane; and (2) 20 weight % to 60 weight % of a compound selected from the group consisting of

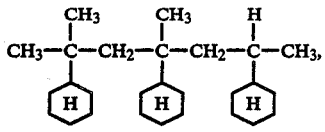

(I)A

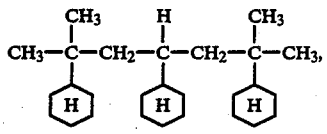

(I)B

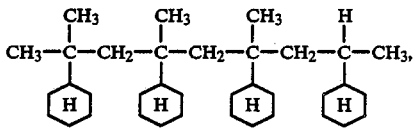

(II)A

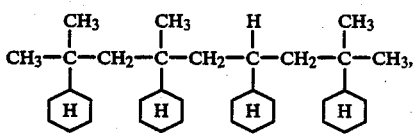

(II)B said composition also including compounds selected from the group consisting of

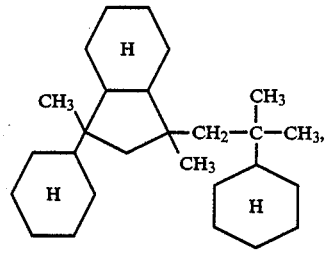

(III)

-continued

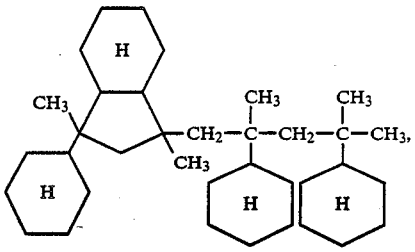

(IV)

and mixtures thereof with the proviso that the total weight of said compounds having the structural formulae III and IV is no more than 50% of the total weight of said compounds represented by formulae IA, IB, IIA and IIB; said composition having a viscosity at 100° C., of 5.0 to 15.0 cSt, thereby transmitting power by the shearing stress caused by an oil film of said composition formed between rotating bodies rotated in a relative relationship.

2. A method in accordance with claim 1 wherein said component (2) is characterized by a maximum presence of the combined amounts of compounds represented by formulae IA and IB of 40 weight %; and a maximum presence of the combined amount of compounds represented by formulae IIA and IIB of 15 weight %, said percentages based on the total weight of the composition.

3. A method in accordance with claim 2 wherein said composition comprises:

40 weight % to 80 weight % of 2,4-dicyclohexyl-2-methylpentane;

20 weight % to 40 weight % of compounds selected from the group consisting of compound IA, compound IB and mixtures thereof; and up to 15 weight % of compounds selected from the group the group consisting of compound IIA, compound IIB and mixtures thereof;

said percentages based on the total weight of the composition.

4. A method in accordannce with claim 1 wherein 0.01 weight % to 5 weight % of an antioxidant, said weight % based on the total weight of said composition, is included in said traction drive fluid.

5. A method in accordance with claim 1 wherein 0.01 weight % to 5 weight % of an antioxidant, said weight % based on the total weight of said composition, is included in said traction drive fluid.

* * * * *